US010457047B2

(12) United States Patent
Brandenberger et al.

(10) Patent No.: US 10,457,047 B2
(45) Date of Patent: Oct. 29, 2019

(54) MOUNTING ASSEMBLY FOR MOUNTING A PLURALITY OF INKJET PRINT MODULES

(71) Applicant: Mouvent AG, Solothurn (CH)

(72) Inventors: Peter Brandenberger, Bellach (CH); Marcel Galliker, Schenkon (CH); Pierino Pierantozzi, Grenchen (CH); Walter Urech, Seengen (CH)

(73) Assignee: MOUVENT AG, Solothurn (CH)

( * ) Notice: Subject to any disclaimer, the term of this patent is extended or adjusted under 35 U.S.C. 154(b) by 0 days.

(21) Appl. No.: 15/746,611

(22) PCT Filed: Jul. 23, 2015

(86) PCT No.: PCT/CH2015/000109
§ 371 (c)(1),
(2) Date: Jan. 22, 2018

(87) PCT Pub. No.: WO2017/011924
PCT Pub. Date: Jan. 26, 2017

(65) Prior Publication Data
US 2018/0215153 A1 Aug. 2, 2018

(51) Int. Cl.
*B41J 2/155* (2006.01)
*B41J 2/165* (2006.01)
*B41J 29/02* (2006.01)

(52) U.S. Cl.
CPC ..... *B41J 2/155* (2013.01); *B41J 2/165* (2013.01); *B41J 2/1652* (2013.01); (Continued)

(58) Field of Classification Search
None
See application file for complete search history.

(56) References Cited

U.S. PATENT DOCUMENTS 8,297,736 B2 10/2012 Gouch et al.
2005/0168514 A1 8/2005 Ueda et al.
2010/0295896 A1* 11/2010 Albertalli ..... B41J 2/2135 347/37

FOREIGN PATENT DOCUMENTS

EP 2 353 868 A1 8/2011
JP 2000-198465 A 7/2000
(Continued)

OTHER PUBLICATIONS

Machine Translation of JP2008183903 A, Yoshida Masahiko, "Printer Having Adjustable Attaching Position of Print Head to Carriage", Aug. 14, 2008, Seiko Epson Corp, see Paragraph 0078.*

*Primary Examiner* — Lisa Solomon
(74) *Attorney, Agent, or Firm* — Birch, Stewart, Kolasch & Birch, LLP

(57) ABSTRACT

A mounting assembly (1) for mounting a plurality of inkjet print modules in an adjoining relationship along a longitudinal direction of the mounting assembly (1) comprises a linear guide (13, 14) extending in the longitudinal direction for supporting the plurality of modules such that the modules are movable along the linear guide (13, 14). It further comprises for each of the plurality of modules a carrier (100.1 . . . 4) for mounting an inkjet print head including an array of nozzles formed on a nozzle face, wherein the carriers (100.1 . . . 4) are supported on the linear guide (13, 14) such that they are movable along the linear guide (13, 14), wherein in a mounted configuration of the inkjet print heads their nozzle face is arranged on a first side of the linear guide (13, 14). Each carrier (100.1 . . . 4) comprises a first adjustment mechanism for adjusting a distance of the carriers 100.1 . . . 4) of two adjoining modules of the plurality of modules, the first adjustment mechanism comprising a first control member having an operating section for mechanically cooperating with a tool for adjusting the (Continued)

distance. Each carrier (100.1 . . . 4) further comprises a second adjustment mechanism for adjusting an angle position of the inkjet print head mounted to the carrier (100.1 . . . 4) with respect to an axis perpendicular to the longitudinal direction, the second adjustment mechanism comprising a second control member having an operating section for mechanically cooperating with a tool for adjusting the angle position. The operating sections of the control members of the first and of the second adjustment mechanism are accessible from the first side of the linear guide (13, 14).

18 Claims, 8 Drawing Sheets

(52) U.S. Cl.
CPC ..... *B41J 2/16552* (2013.01); *B41J 29/02* (2013.01); *B41J 2202/14* (2013.01); *B41J 2202/20* (2013.01)

(56) References Cited

FOREIGN PATENT DOCUMENTS

| | | | | |
|---|---|---|---|---|
| JP | 2008-183903 | A | | 8/2008 |
| JP | 2008183903 | A | * | 8/2008 |
| WO | WO 2009/142927 | A1 | | 11/2009 |

* cited by examiner

MOUNTING ASSEMBLY FOR MOUNTING A PLURALITY OF INKJET PRINT MODULES

TECHNICAL FIELD

The invention relates to a mounting assembly for mounting a plurality of inkjet print modules in an adjoining relationship along a longitudinal direction of the mounting assembly. The assembly comprises a linear guide extending in the longitudinal direction for supporting the plurality of modules such that the modules are movable along the linear guide. The assembly further comprises for each of the plurality of modules a carrier for mounting an inkjet print head including an array of nozzles formed on a nozzle face, wherein the carriers are supported on the linear guide such that they are movable along the linear guide, wherein in a mounted configuration of the inkjet print heads their nozzle face being arranged on a first side of the linear guide. At least one of the carriers comprises a first adjustment mechanism for adjusting a distance of the carriers of two adjoining modules of the plurality of modules, the first adjustment mechanism comprising a first control member having an operating section for mechanically cooperating with a tool for adjusting the distance. At least one of the carriers further comprises a second adjustment mechanism for adjusting an angle position of the inkjet print head mounted to the carrier with respect to an axis perpendicular to the longitudinal direction, the second adjustment mechanism comprising a second control member having an operating section for mechanically cooperating with a tool for adjusting the angle position. The invention further relates to an inkjet printer comprising such a mounting assembly.

BACKGROUND ART

Inkjet printers typically include one or a plurality of inkjet print heads, each including an array of nozzles formed on a nozzle face. The nozzles eject ink drops, the ink being provided from an ink supply through an ink path. Ink drop ejection may be controlled by suitable actuators such as piezoelectric transducers. In so-called "drop-on-demand" inkjet printers, each actuator may be selectively fired to eject a drop at a specific location on a substrate. The print heads and the substrate may be moved relatively to each other during the printing operation.

For high throughput, many inkjet printers comprise a plurality of inkjet print heads. Each print head is part of an inkjet print module. In addition to the print head, such a module features further components for the feeding and conditioning of ink, for controlling the ejection of the ink by the print head and/or for mechanical or thermical purposes. A plurality of such modules are mounted to a mounting assembly, in an adjoining relationship along a longitudinal direction of the mounting assembly, i. e. a so-called "print bar" is created. The nozzle arrays of adjacent print heads are arranged in such a way that seamless printing over the width of a plurality of inkjet print heads is possible. For that purpose, it is important to precisely position the adjacent inkjet print heads on the mounting assembly.

As an example, WO 2009/142927 A1 (Fujifilm Corporation) describes an adjustable print head mounting assembly comprising a frame, a fixed component configured to affix to the frame and a movable component adapted to move relative to the fixed component and the frame. The assembly comprises a first adjustment mechanism and a second adjustment mechanism, being configured to be operated individually to rotate the first or second end of the movable component, respectively, and to be operated together to translate the movable component in an angular direction relative to the frame. The adjustment mechanisms comprise adjustment screws that are accessible from the backside of the mounting assembly. The assembly may further comprise a motor connected to at least one of the first adjustment mechanism and the second adjustment mechanism, e. g. by reduction gears. In order to allow for seamless printing, the nozzle arrays are rhomboid shaped and the arrays of two adjoining print heads are slightly offset to each other in a direction perpendicular to the longitudinal direction.

Similarly, U.S. Pat. No. 8,297,736 B2 (FFEI Limited) relates to an assembly with a plurality of inkjet heads mounted thereon. The heads are mounted to a plurality of spaced apart carrier members mounted for relative movement along an elongate path. Each carrier includes laterally offset first and second coupling positions whereby in use alternate inkjet heads are coupled at each of their ends between first coupling positions or between second coupling positions, respectively, of successive pairs of carrier members. At least one coupling position of each carrier member includes an adjustment mechanism to enable parts of inkjet heads coupled to the respective coupling positions to be relatively aligned in the elongate direction.

Using the prior art mechanisms, manually adjusting the position of a plurality of inkjet print heads in order to allow for seamless printing is cumbersome. Providing each of the adjustment mechanisms with motor drives leads to substantially increased complexity, cost and weight of the inkjet printing assembly.

SUMMARY OF THE INVENTION

It is the object of the invention to create a mounting assembly for mounting a plurality of inkjet print modules pertaining to the technical field initially mentioned, that is cost-efficient and lightweight and that allows for precise adjustment of the positions of the inkjet print heads of the print modules.

The solution of the invention is specified by the features of claim 1. According to the invention the operating sections of the control members of the first and of the second adjustment mechanism are accessible from the first side of the linear guide.

It has turned out to be very favourable to arrange the control members of the adjustment mechanisms on the first side, i. e. the nozzle face side of the print modules or in a region adjacent to the nozzle face side, respectively. Firstly, the inkjet print heads should be firmly attached to the carriers close to their nozzle face in order to ensure that the positioning of the nozzle array is precise and stable. This leads to comparably long and therefore rather heavy mechanical elements if the control members of the adjustment mechanisms are to be reached from the rear side of the print modules. Furthermore, access to the control members may be obstructed by further elements of the print modules, which means that they need to be partially disassembled if re-adjustment is required.

The number of adjustment mechanisms required on the carriers depends on the configuration of the carriers and the adjustment mechanisms. In a particular embodiment, each of the carriers comprises a second adjustment mechanism for adjusting the angle position of the respective print head, whereas the number of carriers with a first adjustment mechanism is one less because it is sufficient to adjust only the mutual distance between the print heads. In another embodiment, each of the carriers may be provided with a first as well as a second adjustment mechanism.

Arranging the control members on the front side, i. e. the nozzle face side or in a region immediately adjacent the nozzle face side, e. g. on a lateral side but in a position that may easily be reached from the first side of the linear guide, reduces the length and weight of the mechanical elements and improves their stiffness, thereby improving the precision of the adjustment. The mounting assembly as a whole may be constructed to be lightweight and compact.

In a particularly preferable embodiment, the control members are arranged on the nozzle face side and may be accessed within a footprint defined by the inkjet print head.

Usually, in order to ensure seamless printing, the required adjustment range will be rather small, e. g. less than about 0.5 mm along the longitudinal direction or ±0.5° about the axis perpendicular to the longitudinal direction, in particular about an axis that is perpendicular to the plane defined by the nozzle face.

The nozzle array as well as the base plate the nozzle array is arranged on may have a rhomboid shape. The main axis of the nozzle array may be slightly slanted with respect to the longitudinal axis of the mounting assembly, leading to a slight offset of neighbouring nozzle arrays. This allows for precisely adjusting the distance and rotational relationship of adjoining print heads.

In an alternative embodiment, the nozzle arrays and the corresponding base plates have a different shape, e. g. rectangular. In this case, the nozzle arrays may be arranged in a staggered pattern, in order to enable seamless printing.

Preferably, the mounting assembly according to the invention is used in the context of an inkjet printer comprising at least one such mounting assembly as well as an adjusting robot comprising a tool for cooperating with the operating sections of the control members of the first and of the second adjustment mechanism. The robot is arranged on the first side of the linear guide, i. e. on the nozzle face side. It allows for easily reaching the operating sections of the adjustment mechanisms on the nozzle face side. The adjusting robot may feature a single tool which may interact with the control members of both the first and the second adjustment mechanism. Alternatively, the adjusting robot may feature two separate tools for interacting with the control member of the first or the second adjustment mechanism, respectively.

Preferably, the adjusting robot selectively cooperates with a single one of the inkjet print heads, wherein the adjusting robot is at least movable along the longitudinal direction. This allows for optimum flexibility with respect to the operation of the adjusting robot. Furthermore, in principle the adjustment mechanisms of all the print modules may be sequentially operated by a single compact, non-expensive and lightweight unit.

In certain embodiments of the invention, the adjusting robot may as well be movable along a further direction perpendicular to the longitudinal direction or even in three mutually perpendicular directions, depending on the needed degrees of freedom.

Preferably, the control members are screws and the operating sections are screw heads. This allows for a particularly easy operation of the adjustment mechanisms. The screw head may have a geometry according to a known standard such as a hexagon socket or torx.

Preferably, a rotational axis of the screws is perpendicular to a plane defined by the nozzle face, and the screw heads point away from the linear guide.

Accordingly, in a preferred embodiment, the adjusting robot comprises a drive for rotatably operating the tool. This allows for easily and automatically adjusting the positions of the modules. If a screw is used on the adjustment mechanisms, the tool will have a corresponding screwdriver-like geometry.

In contrast to individual motor drives for each module, the motor drives of the adjusting robot allow for adjusting the position of a plurality of modules. Furthermore, the adjusting robot including all its components is separate from the mounting assembly with the print heads, i. e. the corresponding components do not need to be moved if the print heads are moved, e. g. in a direction across the substrate to be printed.

Preferably, at least one of the screws comprises a fine thread. This allows for precise adjustment of the corresponding adjustment mechanism. Furthermore, if a motor drive is used for operating the screw, a reduction gear may be spared or the gear transmission ratio may be chosen to have a smaller value. Besides, depending on the further geometry of the adjustment mechanism a screw having a fine thread may be self-locking, which allows for simplifying the construction of the adjustment mechanism.

Apart from screws, other types of control members are possible, such as control members that are operated in a linear fashion. In this case, the tools of the adjusting robot will also work in a linear fashion.

Advantageously, the linear guide comprises two longitudinal rails, and the carriers are slidably mounted on the rails. The rails allow for a simple yet rigid construction of the mounting assembly. The rails may have different geometries, and the carriers may interact with the rails by means of sliding bearings, roller bearings, etc. In particular, the carriers comprise a base which is provided with two through borings for accommodating the rails. In this case, sliding bearings are preferred.

In a preferred embodiment, the rails comprise a mechanism for maintaining a predetermined temperature. This mechanism may be a cooling and/or heating mechanism. In particular, the rails comprise a duct a heat exchanging medium is flowing through. The mechanism allows for maintaining a constant temperature of the rails and carriers mounted on the rails and therefore for maintaining a constant geometry of these elements. Besides being provided with the duct, the rails are preferably made from a material with high thermal conductivity. This applies as well to the carriers.

The invention is not limited to assemblies having a pair of rails for linearly guiding the carriers. The carriers may as well be supported by a single longitudinal rail or more than two rails. They may also be supported on a spindle or between suitable guide surfaces.

In a preferred embodiment, the carriers are mounted to the linear guide in such a way that the plurality of carriers are urged against a first end of the linear guide, whereas the first adjustment mechanisms allow for adjusting the mutual distance of the carriers of two adjoining modules. This means that all the modules attached to the same mounting assembly are urged against each other and the outermost carrier is supported on the first end of the linear guide. In general, it is ensured that the adjoining carriers closely contact each other and therefore all carriers take a defined position with respect to the linear guide.

Preferably, a compression spring acts onto an outermost carrier opposite the first end of the linear guide for urging the plurality of carriers against the first end. The compression spring may be constituted e. g. by a mechanical or pneumatic spring.

In a preferred embodiment, the first adjustment mechanism for adjusting a distance of the carriers of two adjoining modules comprises a first wedge element contacting two adjoining carriers, wherein a position of the wedge element is adjustable by operating the first control member. The first wedge element is formed and positioned in such a way that adjusting its position leads to an adjustment of the relative distance between the two adjoining carriers, i. e. the adjustment of the position is effected in a direction in which the thickness of the first wedge element varies. Most preferably, both of the two adjoining carriers directly contact opposing surfaces of the first wedge element. This allows for a simple construction and high positioning precision.

Preferentially, a lever cooperates with the first control member and the first wedge element. This means that the first control member acts onto the lever, and the lever acts on the first wedge element. In particular, if the first control member is a screw, the lever is pivotally supported on an axis that is fixed with respect to the carrier and is hinged to a linear adjusting element, the position of which is adjusted by rotating the screw, and hinged to the first wedge element such that a change in the position of the linear adjusting element is transferred to a change in the linear position of the first wedge element.

In a preferred embodiment, the second adjustment mechanism for adjusting an angle position of the inkjet print head comprises a second wedge element mechanically coupled to the second control member for adjusting the angle position.

Preferably, the carrier further comprises a rotatable mount for the inkjet print head, the rotatable mount having a projecting element cooperating with the second wedge element. This combination allows for a high positioning precision if the required travel is small. The projecting element may further cooperate with an elastic element which contacts a surface that is opposite the contact surface with the second wedge element. Accordingly, the rotational position of the projecting element and thus of the rotatable amount is always defined, in function of the angular position of the second wedge element.

The projecting element may be a portion of the rotatable mount or a separate element that is affixed to the rotatable mount.

The rotatable mount may be part of a mechanical interface, which accommodates the inkjet print head and which cooperates with the carrier for precisely mounting the print head on the carrier. In particular, the mechanical interface comprises an outer shell surface which is cylindric or comprises a section that corresponds to a region of a cylindrical surface. This surface cooperates with a corresponding bore of the carrier. Accordingly, the geometry of the mechanical interface precisely defines the rotation axis for adjusting the angle position. Fixation of the inkjet print head to the mechanical interface may be effected e. g. by gluing.

Using the two adjustment mechanisms, the distance and the angle position of the print heads may be independently adjusted, which allows for a simple, fast and flexible readjustment of the print bar if required.

Preferably, the adjusting robot comprises an adjusting section comprising the tool and a cleaning section comprising a device for cleaning the array of nozzles of the inkjet print head mounted on a carrier in a cooperating position with the adjusting robot. Accordingly, the adjusting robot allows for selectively cleaning the arrays of single inkjet print heads. In case of contaminated or blocked nozzles it is not anymore necessary to clean the entire print bar. Accordingly, the ink consumption is reduced.

Advantageously, the adjusting robot comprises a first operating configuration in which the adjusting section is in cooperating position with one of the plurality of carriers and a second operating configuration in which the cleaning section is in cooperating position with the array of nozzles of the inkjet print head mounted to the carrier. Depending on the desired operation the adjusting robot is set either to the first operating configuration or to the second operating configuration. In a particular embodiment, the adjusting section and the cleaning section are arranged at two opposite ends of a rotatable arm, wherein rotating the arm allows for switching between the two configurations.

In particular, the device for cleaning comprises at least one lip for cooperating with the array of nozzles of the inkjet print head and least two nozzles for ejecting a cleaning agent and a rinsing solution, respectively. This allows for a two-stage cleaning process, wherein contaminations are etched and possibly dissolved in the first stage and residues of the cleaning agent and/or the contamination are removed in the second stage.

Other designs are possible. A single nozzle may be used for selectively ejecting the cleaning agent or the rinsing solution. Furthermore, in principle, the lip may be dispensed with.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

PREFERRED EMBODIMENTS

Figure 1:
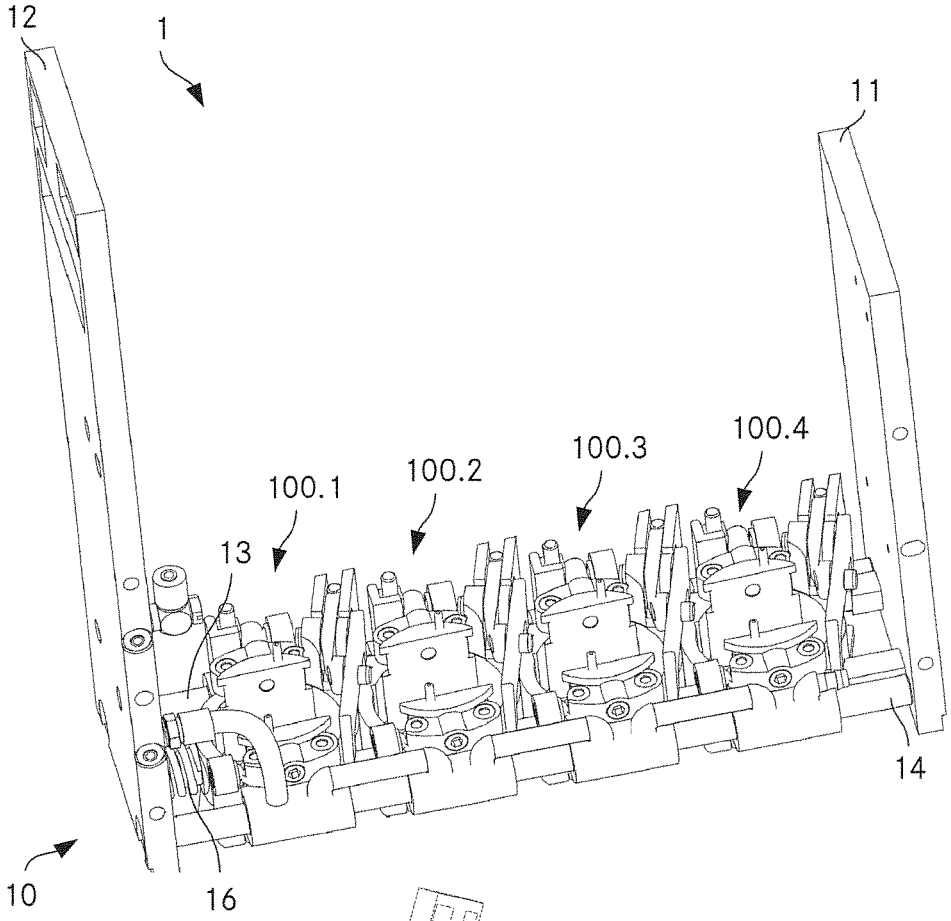
FIG. 1 An oblique view of a mounting assembly according to the invention.
Figure 2:
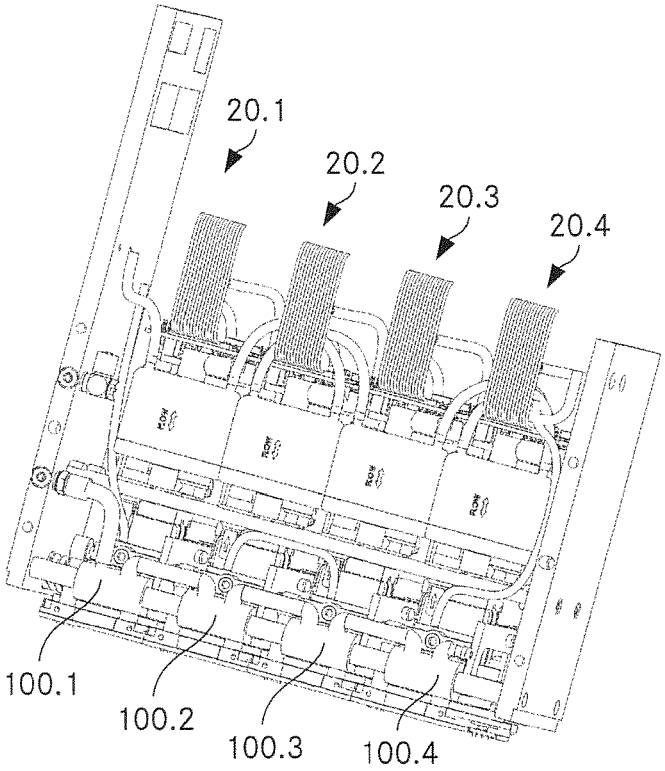
FIG. 2 an oblique view of the mounting assembly with print heads installed.

An embodiment of the invention is described in connection with FIGS. 1-11. FIG. 1 is an oblique view of a mounting assembly according to the invention, FIG. 2 shows the mounting assembly with print heads installed. The mounting assembly 1 comprises a frame 10 including two basically rectangular plate shaped side parts 11, 12, which are arranged parallel to each other in a distance. The lower regions of the side parts 11, 12 are connected by two parallel rails 13, 14. Four carriers 100.1, 100.2, 100.3, 100.4 are supported on the rails 13, 14. The carriers 100.1 . . . 4 are described in more detail below, in connection with FIGS. 3-5.

Adjoining carriers 100.1 . . . 4 contact each other, they are urged to one of the side plates 11 by a compression spring 16 which are supported on the rails 13, 14 adjoining the other side plate 12 and which contact the first carrier 100.1.

In each of the carriers 100.1 . . . 4 a print head 20.1 . . . 4 is supported. The mounted print heads 20.1 . . . 4 are accommodated in a space defined by the two side parts 11, 12 of the mounting assembly 1. In a manner known as such, the print heads 20.1 . . . 4 inter alia comprise an ink nozzle array and are components of print modules that comprise further components for feeding and preconditioning ink and controlling the ejection of the ink by the ink nozzle array. In the mounted configuration of the print heads 20.1 . . . 4, the ink nozzle array is positioned on a first side of the carriers 100.1 . . . 4 (below in the view shown in FIG. 2), whereas the other components of the print heads 20.1 . . . 4 are positioned on a second side of the carriers 100.1 . . . 4, which is opposite to the first side (above the carriers 100.1 . . . 4 in the view shown in FIG. 2). The two rails 13, 14 are provided with a duct that is part of a heat exchanging fluid circuit. This ensures that the rails 13, 14 and the carriers 100.1 . . . 4 may be held at a predetermined temperature, thus minimizing thermal effects on the geometry of the mounting assembly.

An inkjet printing device may include a single or several mounting assemblies with print heads installed. The number of print heads in a mounting assembly may be below or above 4 (e. g. 2, 3 or 6).

Further elements will be attached to the mounting assembly, namely a manifold for the distribution of ink to the different print modules, electronic components for controlling the printing operation and a housing enclosing the different components.

Figure 3A:
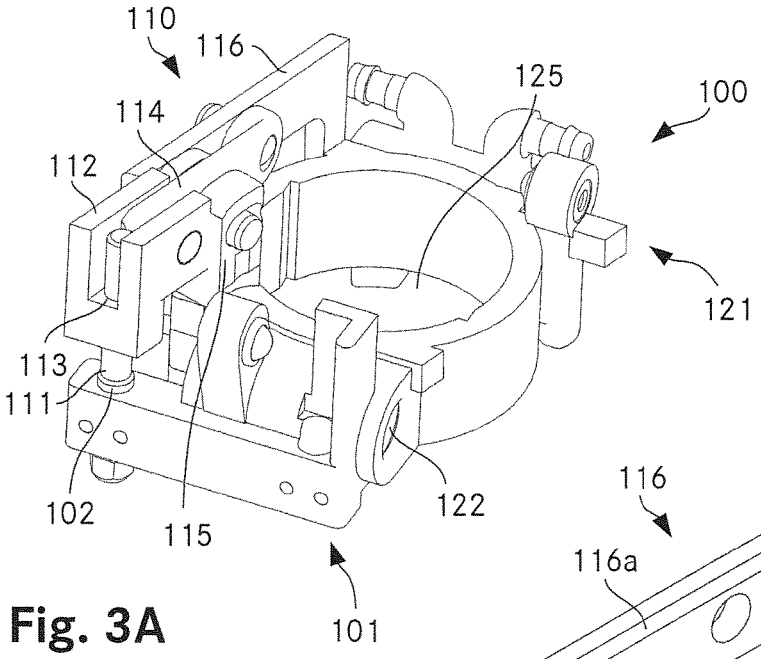
FIG. 3A an oblique view of a carrier of the mounting assembly with the mechanism for the adjustment of the distance to an adjoining carrier.
Figure 3B:
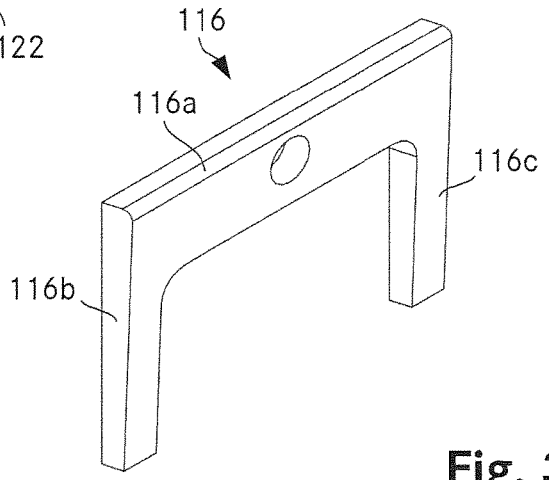
FIG. 3B an oblique view of the wedge element of the mechanism.

The FIG. 3A is an oblique view of a carrier 100 of the mounting assembly with the mechanism for the adjustment of the distance to an adjoining carrier. The FIG. 3B is an oblique view of the wedge element of the mechanism. It is to be noted that of the four carriers 100.1 . . . 4 shown in the FIGS. 1 and 2, only three of them, namely carriers 100.2 . . . 100.4, include such a mechanism as in order to enable seamless printing it is sufficient to adjust the mutual distance of adjoining carriers 100.1 . . . 4, i. e. three distances.

The mechanism 110 includes an adjustment screw 111 with a fine thread, the lower part of which is supported in a vertical bore 102 of a base body 101 of the carrier 100. A screw head of the adjustment screw 111 is situated below the base body 101 and includes a hexagon socket. The upper part of the adjustment screw 111 cooperates with a bore 113 of a link element 112 (cf. also FIG. 8B). A lever 114 is pivotally supported on a pillar 115 of the base body 101, its pivoting axis runs parallel to a main plane of the base body 101 of the carrier 100. One end of the lever 114 is linked to the link element 112, the other end of the lever 114 is linked to a wedge element 116. If the link element 112 is lowered by corresponding action of the adjustment screw 111, the wedge element 116 is raised due to action of the lever 114 and vice versa (cf. also FIG. 8B).

The wedge element 116 as shown in FIG. 3B comprises a yoke 116*a* linking two legs 116*b*, 116*c*. Starting from the yoke 116*a*, a thickness of the legs 116*b*, 116*c* decreases. The wedge element 116 contacts the base body of the adjoining carrier. Due to the geometry of the legs 116*b*, 116*c*, the distance between the adjoining carriers is reduced if the wedge element 116 is raised, and the distance between the adjoining carriers is increased if the wedge element 116 is lowered.

The base body 101 further comprises two through bores 121, 122 running parallel to each other and parallel to the main plane of the base body 101. In the mounted configuration of the carrier 100 they cooperate with the rails 13, 14 of the mounting assembly 1. Finally, the base body 101 comprises a central opening 125 for accommodating the print head (cf. FIG. 4).

Figure 4:
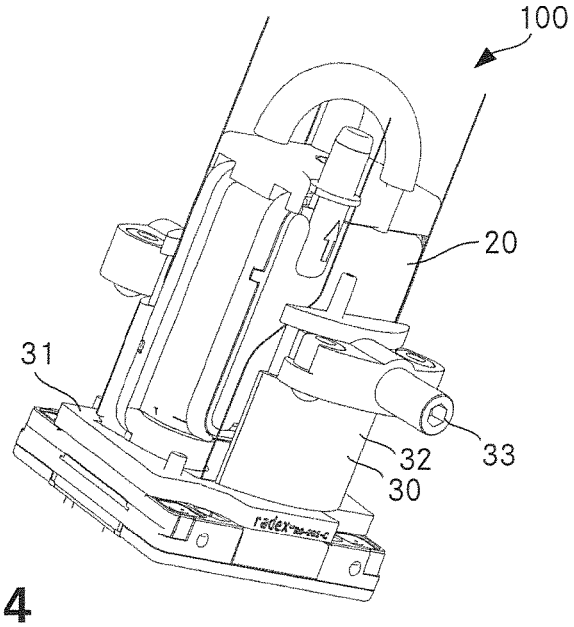
FIG. 4 an oblique view of the print head with an interfacing element for supporting the print head in the carrier.

The FIG. 4 is an oblique view of the print head 20 with an interfacing element 30 for supporting the print head 20 in the carrier. The print head 20 is firmly glued to the interfacing element 30. The latter comprises a base part 31 having a central opening for accommodating the print head 20 as well as an upper part 32 having an arcuate outer shell surface, a rotational symmetry axis standing perpendicular to a main surface of the base part 31 and a positioning pin 33 protruding perpendicular to the outer shell surface.

The print head 20 being firmly glued to the interfacing element 30, the rotational symmetry axis of the outer shell surface of the upper part 32 is exactly perpendicular to the plane defined by the nozzle array of the print head 20. In the installed configuration, the interfacing element 30 cooperates with the carrier 100, in particular with the central opening 125 of the carrier. For that purpose, in order to ensure precise positioning of the print head, the outer shell surface of the interfacing element 30 is precisely adapted to the geometry of the opening 125.

Figure 5A:
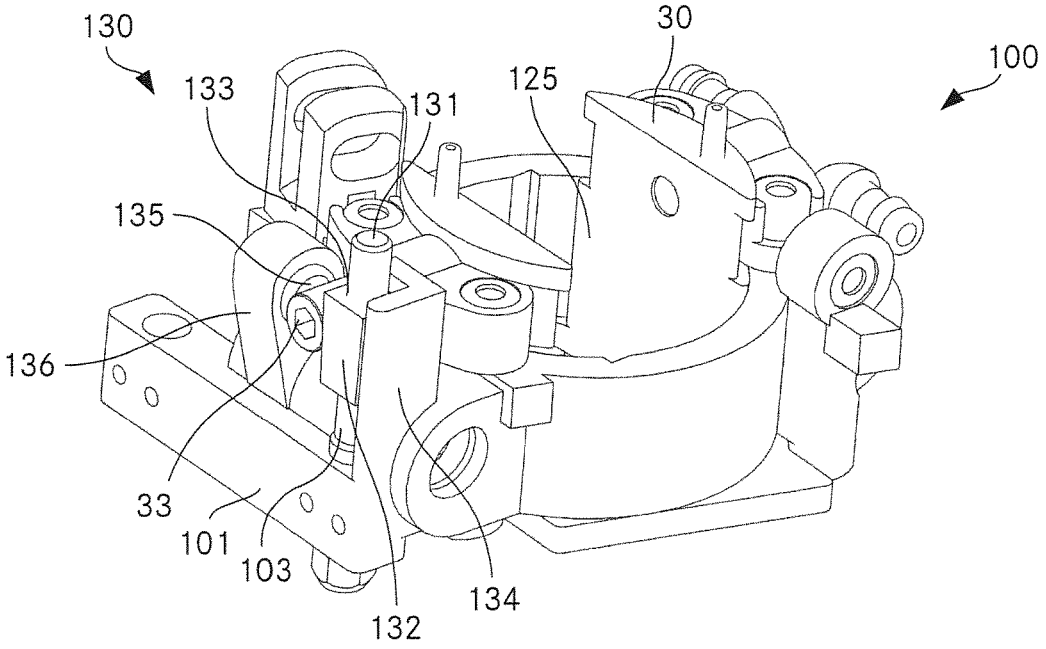
FIG. 5A an oblique view of the carrier of the mounting assembly with the mechanism for the adjustment of the angular position of the print head.
Figure 5B:
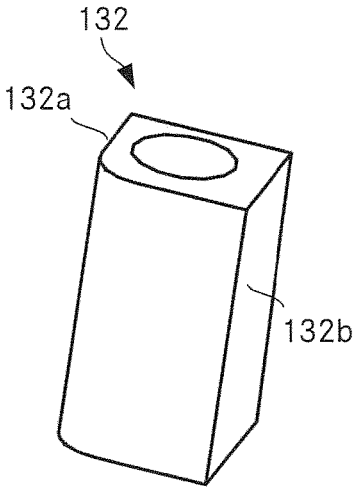
FIG. 5B an oblique view of the wedge element of the mechanism.

The FIG. 5A is an oblique view of the carrier of the mounting assembly with the mechanism for the adjustment of the angular position of the print head. The FIG. 5B is an oblique view of the wedge element of the mechanism. In contrast to the mechanism for adjusting the mutual distance between adjoining carriers, all the carriers 100.1 . . . 4 comprise such a mechanism for adjusting the angular position as such adjustment may be required for any of the print heads.

The mechanism 130 includes an adjustment screw 131 with a fine thread, the lower part of which is supported in a further vertical bore 103 of the base body 101 of the carrier 100. A screw head of the adjustment screw 131 is situated below the base body 101 and includes a hexagon socket. The upper part of the adjustment screw 131 cooperates with a bore 133 of a wedge element 132.

As shown in FIG. 5B, the wedge element 132 comprises an outer guide surface 132*a* which cooperates with a fixed pillar 134 of the base body 101 of the carrier 100. Opposite to the guide surface 132*a*, the wedge element 132 comprises a generally planar wedge surface 132*b*, the distance of which increasing from top to bottom (cf. also FIGS. 9B, 10B). The pillar 134 of the base body 101 ensures that a rotational position of the wedge element 132 is constant, independent from the position of the adjustment screw 131. Nevertheless, by rotating the adjustment screw 131, the vertical position of the wedge element 132 may be adjusted.

The wedge surface 132*b* of the wedge element 132 cooperates with the positioning pin 33 of the interfacing element 30 accommodated in the central opening 125 of the carrier 100. Opposite to the wedge element 132, the positioning pin 33 contacts an elastic element 135 which is mounted on a pin 136 fixedly attached to the base body 101 of the carrier 100. The position of the positioning pin 33 and thus the angular position of the print head glued to the interfacing element 30 are always precisely defined by the height of the wedge element 132. Lowering the wedge element 132 by a corresponding rotation of the adjustment screw 131 corresponds to a slight clock-wise rotation (seen from above) of the interfacing element 30, rising the wedge element 132 corresponds to a slight anti-clock-wise rotation.

Figure 6:
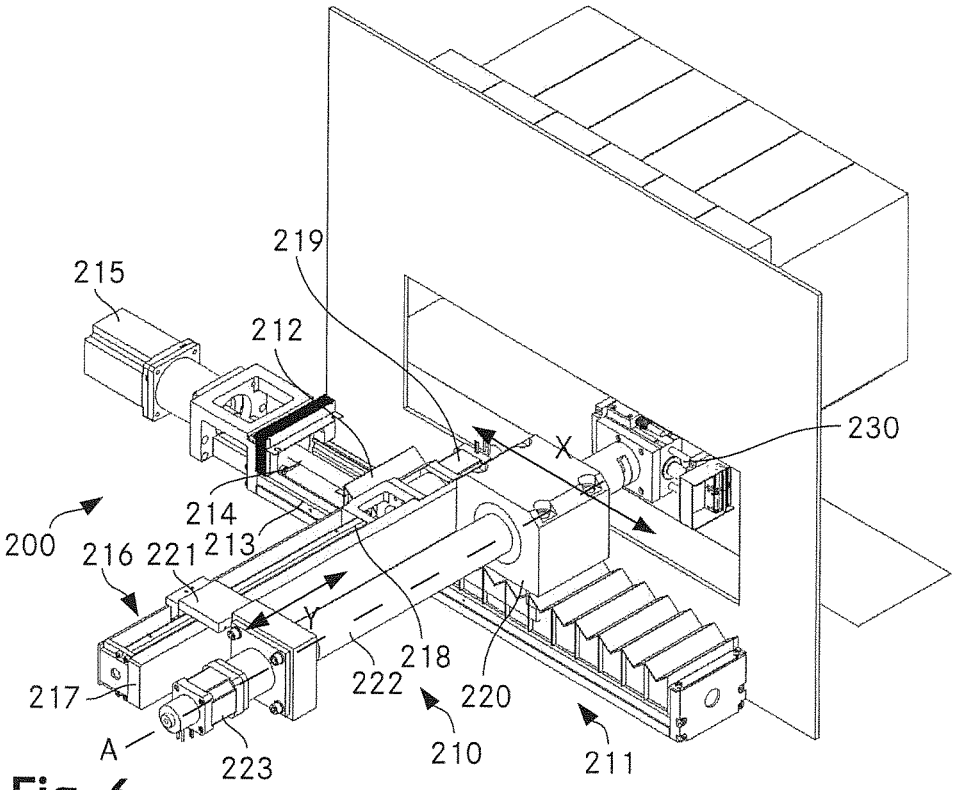
FIG. 6 an oblique view of an adjusting and cleaning robot according to the invention.
Figure 7:
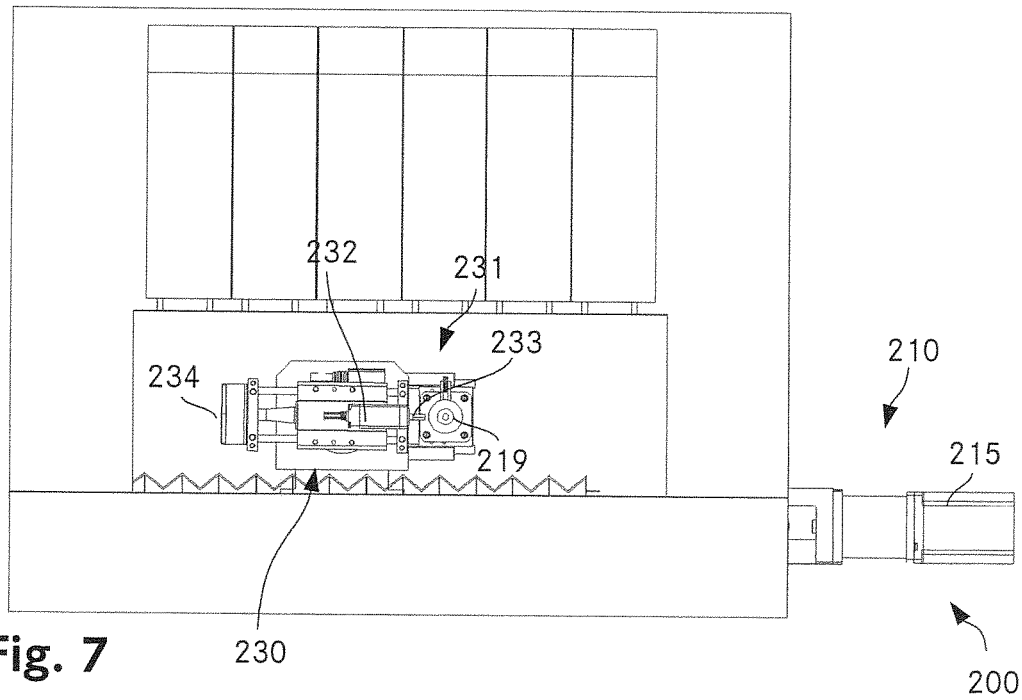
FIG. 7 a side view of the adjusting and cleaning robot.

The FIG. 6 is an oblique view of an adjusting and cleaning robot according to the invention cooperating with a print bar comprising an assembly similar to the one as described above, in connection with FIGS. 1-5. The main difference is the number of print heads which is 6 instead of 4. The FIG. 7 is a side view of the adjusting and cleaning robot. The robot 200 includes a positioning system 210 and a head 230 that may be positioned along two Cartesian axes, namely the longitudinal axis X, a further horizontal axis Y that is perpendicular to X, and about a rotational axis A (parallel to direction Y) by the positioning system 210.

The positioning system 210 comprises a first linear guide 211, a carriage 212 being supported on two rails 213 of the linear guide 211. The carriage 212 cooperates with a spindle 214 which is driven by a servo motor 215 in such a way that the carriage 212 may be positioned along the rails 213 in X direction.

The carriage 212 carries a second linear guide 216 provided with a guide rail 217 and a spindle 218 operated by a further servo motor 219. Furthermore, a guide block 220 is attached to the carriage 212. A further carriage 221 is supported on the guide rail 217 of the first carriage 212 and may be positioned in Y direction by means of the servo motor 219 and the spindle 218. A rotatable shaft 222 is rotatably supported on the further carriage 221 and rotatably and slidably supported on the guide block 220. A further servo motor 223 supported on the further carriage 221 is coupled to the rotatable shaft 222 and allows for rotating the shaft about a rotation axis A parallel to direction Y.

The head 230 of the robot 200 is coupled to the opposite end of the rotatable shaft 222. It comprises at one of its free ends an adjusting unit 231 having a drive motor 232 coupled to a hexagonal tool head 233. The tool head 233 extends into a direction perpendicular to the rotation axis A. At the opposite free end, the head 230 comprises a cleaning unit 234.

The cleaning unit 234 comprises two nozzles that are connected to supplies for a cleaning agent and a rinsing solution, respectively. It further comprises a wiper that may interact with the nozzle arrays in order to distribute or wipe off the cleaning agent and the rinsing solution, respectively. It may comprise further components such as a nozzle for ejecting pressurized air, etc.

Using the servo motors 215, 217, 223 the head 230 may be positioned along the X and Y directions, furthermore, the head may be rotated about the rotation axis A. This allows for selectively positioning the adjusting unit 231 or the cleaning unit 234 and a cooperating relationship with the adjustment screws of any of the carriers of the mounting assembly or the nozzle array of any of the print heads, respectively.

The FIGS. 8-11 show different positions of two adjoining print heads and the corresponding configurations of the mechanisms for adjusting the mutual distance and the angular position of the heads. The FIGS. 8A, 9A, 10A, 11A show a bottom view of the two print heads mounted to the mounting assembly according to the invention. They show the two rails 13, 14 supporting the carriers 100 of the two print heads. The print heads 20.2, 20.3 are affixed to the carriers 100, the nozzle arrays 21.2, 21.3 of the print heads 20.2, 20.3 are visible. The bottom surfaces of the print heads 20.2, 20.3 as well as the nozzle arrays 21.2, 21.3 are both rhomboid shaped, the nozzle arrays 21.2, 21.3 being slightly slanted with respect to a longitudinal axis which runs parallel to the two rails 13, 14. This allows for having a seamless transition between the two adjoining modules.

The position of one of the modules may be adjusted by operating the screw head of the adjustment screw 111 for the mutual distance, and the screw head of the adjustment screw 131 for the rotational position. Both screw heads are directly accessible from the bottom surface of the carrier 100.

Figure 8A:
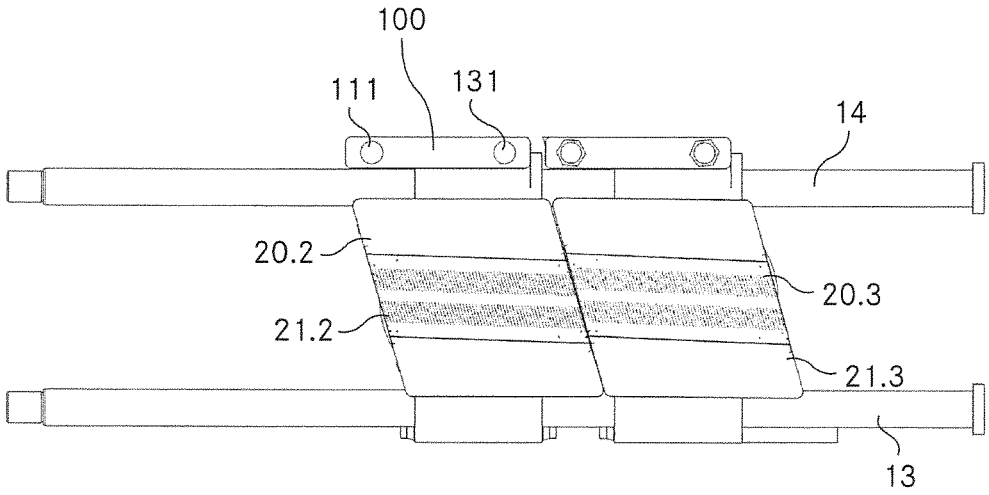
FIG. 8A a bottom view of two print modules in a basic position.
Figure 8B:
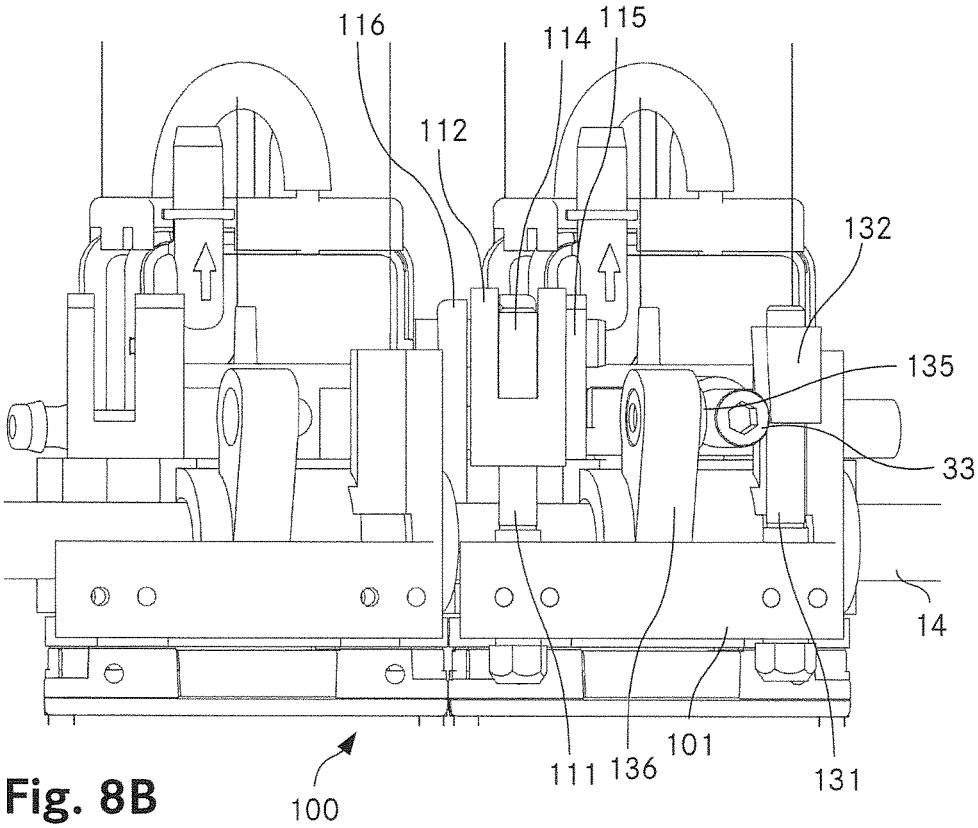
FIG. 8B an oblique view of the carrier of one of the modules in the basic position.
Figure 9A:
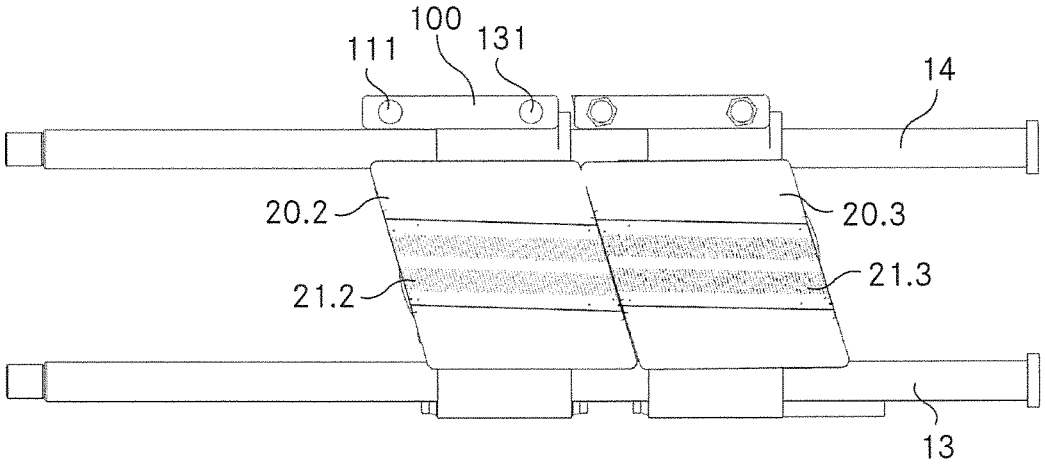
FIG. 9A a bottom view of two print modules, where one of the print modules is angularly displaced with respect to the other print module.

The FIGS. 8B, 9B, 10B, 11B show oblique views of the carrier of one of the modules in the different positions depicted in FIGS. 8A, 9A, 10A, 11A: In FIG. 8A, B, the basic position is shown; FIG. 9A, B shows an angularly displaced module, FIG. 10A, B relates to two modules with increased distance and FIG. 11A, B to two modules with reduced distance.

As can be seen from FIG. 8B, which relates to the basic position, the position of the link element 112 and of the wedge element 132 are both at about half the height of the upper portion of the respective adjustment screw 111, 131 supported in the base body 101 of the carrier 100. Accordingly, the wedge element 116 is at about half its maximum height, controlled via the lever 114 supported on the pillar 115 of the base body 101. Similarly, the positioning pin 33 controlling the angular position of the print head is also at about a middle position. Its exact position is determined by the position of the wedge element 132 and the elastic element 135 mounted on the fixed pin 136 of the base body 101. Due to the fine threads, the two adjustment screws 111, 131 are self locking, i. e. it is sufficient to rotate the screws until the print heads attain their desired position and orientation, no step to lock that position is required.

Figure 9B:
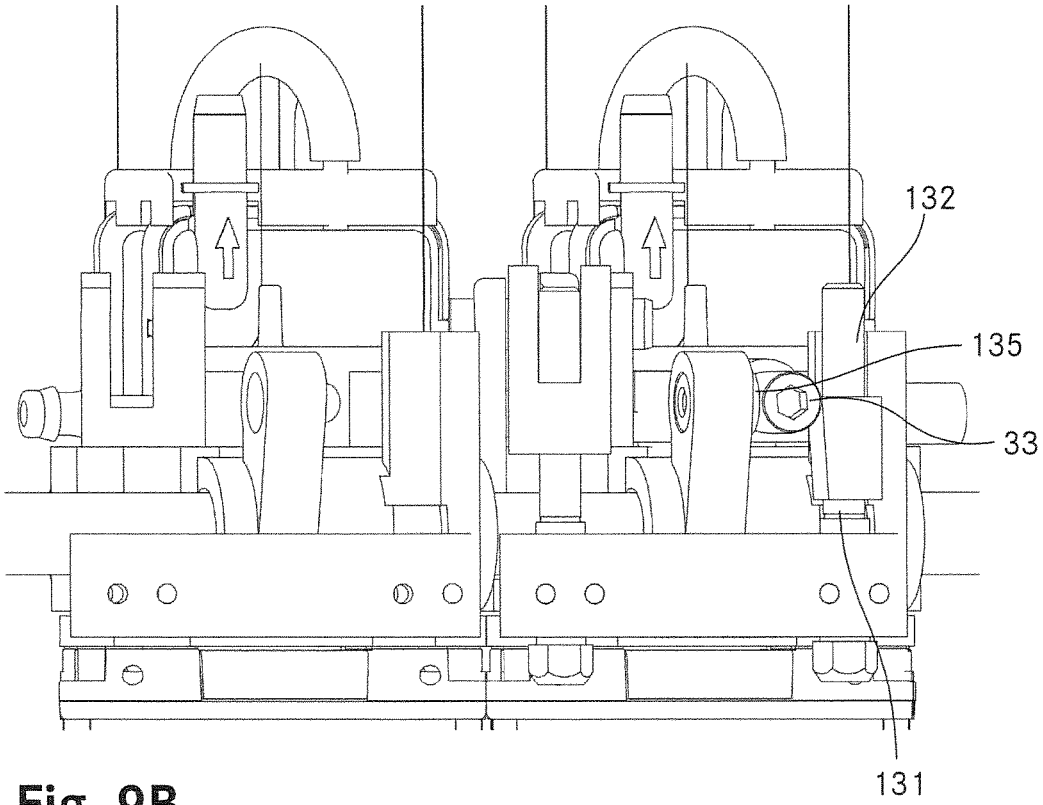
FIG. 9B an oblique view of the carrier of the angularly displaced module.

In the situation shown in FIGS. 9A, 9B and compared to the situation shown in FIGS. 8A, 8B, the angular position of the left print head 20.2 is rotated slightly in the anti-clockwise direction (seen from the bottom). This is achieved by rotating the adjustment screw 131 in such a way that the wedge element 132 is lowered. The portion of the wedge element 132 having a smaller cross-section will thus interact with the positioning pin 33. Due to the elastic force exerted by the elastic element 135 it is ensured that the positioning pin 33 is firmly supported against the wedge element 132. The adjustment screw 131 and its fine thread is designed in such a way that the shown situation is reached if the screw is rotated 7.8 rotations in the clock-wise direction. The resulting angle is 0.437°.

Figure 10A:
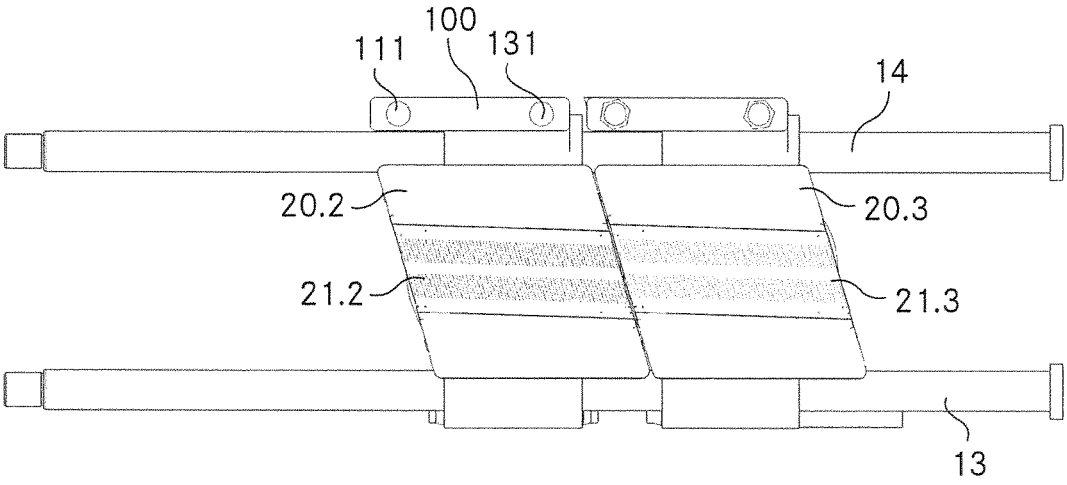
FIG. 10A a bottom view of two print modules with an increased mutual distance.
Figure 10B:
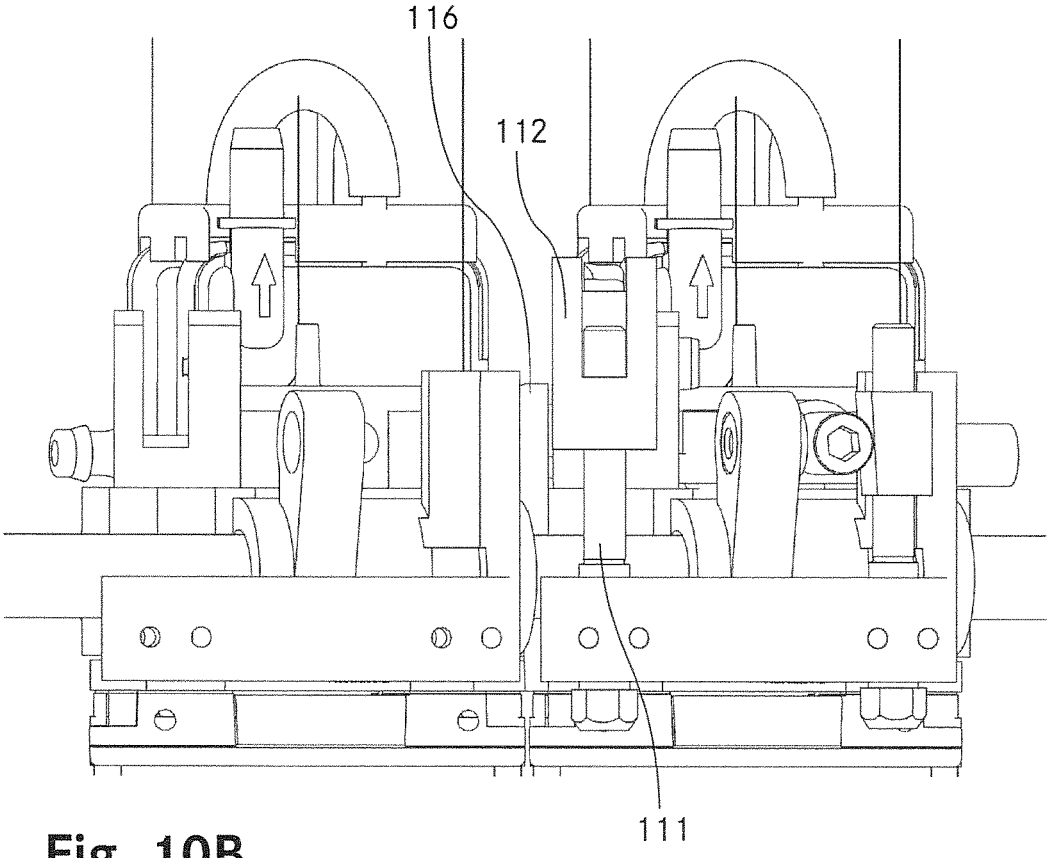
FIG. 10B an oblique view of the carrier of one of the modules with increased distance.

In the situation shown in FIGS. 10A, 10B and compared to the situation shown in FIGS. 8A, 8B, the distance of the two adjoining print heads 20.2, 20.3 is increased by 0.200 mm. This is achieved by rotating the adjustment screw 111 about 9.5 rotations in anti-clockwise direction. This causes the height of the link element 112 to increase and consequently the height of the wedge element 116 to decrease. A section of the wedge element 116 having an increased cross-section will thus cooperate with the two base bodies of the carriers and thus increase the distance between the two print heads 20.3, 20.4.

Figure 11A:
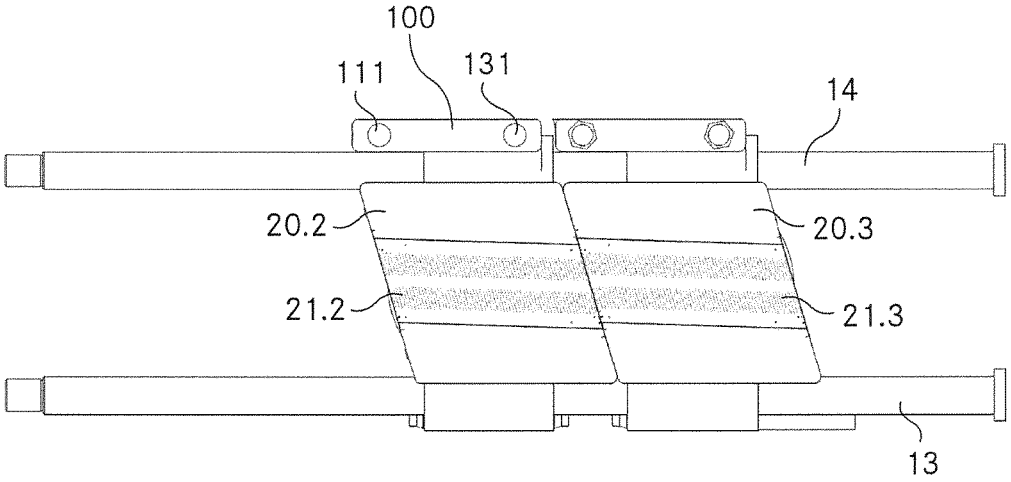
FIG. 11A a bottom view of two print modules with an reduced mutual distance.
Figure 11B:
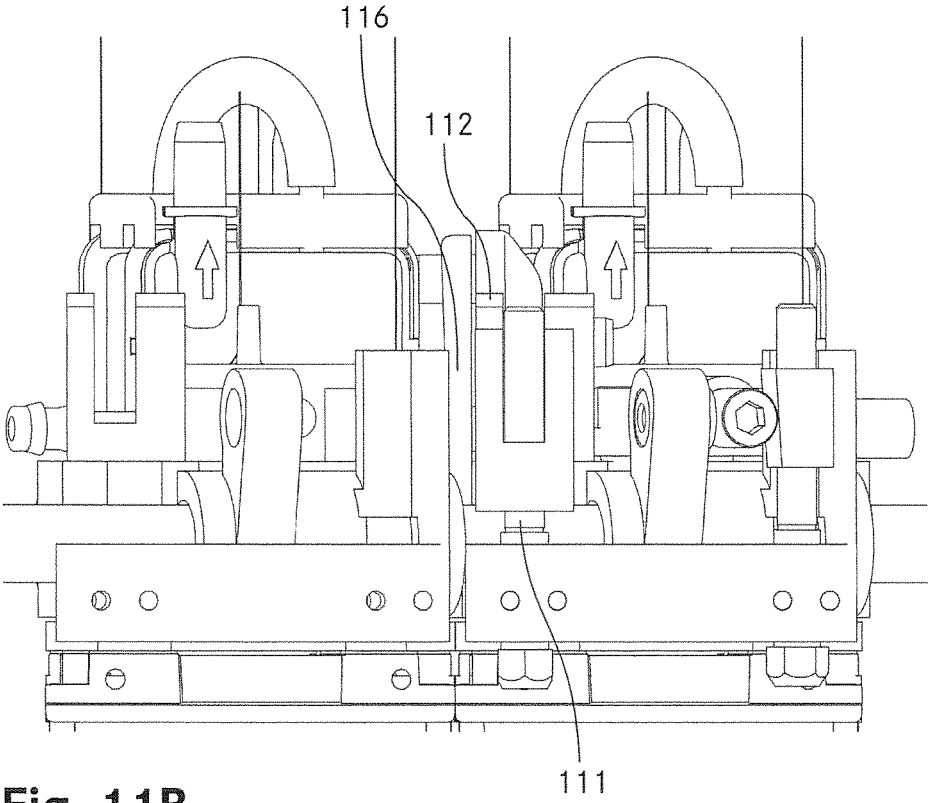
FIG. 11B an oblique view of the carrier of one of the modules with reduced distance.

In the situation shown in FIGS. 11A, 11B and compared to the situation shown in FIGS. 8A, 8B, the distance of the two adjoining print heads 20.2, 20.3 is decreased by 0.200 mm. This is achieved by rotating the adjustment screw 9.5 rotations in clockwise direction. This causes the height of the link element 112 to decrease and consequently the height of the wedge element 116 to increase. A section of the wedge element 116 having a decreased cross-section will thus cooperate with the two base bodies of the carriers and thus decrease the distance between the two print heads 20.3, 20.4 to the minimum.

Adjustments may be caused by independently rotating the two adjustment screws 111, 131. This allows for precisely adjusting the position of the nozzle arrays 21.2, 21.3. The re-adjustment of the position of one of the print heads, especially the re-adjustment of the mutual distance of adjoining heads does not require a complete re-adjustment of the mutual distances between other pairs of adjoining heads, because the further heads will keep their relative positions and the change in the total length of the succession of heads is balanced by a slightly changed compression of the spring.

The invention is not limited to the embodiment described above. In particular, the adjustment mechanisms of the carriers may be constructed in a different way. The same applies to the linear guide for supporting the carriers. The adjusting and cleaning robot may as well be embodied differently. In particular, the number of degrees of freedom provided by its positioning system may be different, and the corresponding axes may be provided by different mechanisms. The cleaning unit may be arranged next to the adjusting unit, on the same side of the head of the robot, or it may lack completely.

In summary, it is to be noted that the invention provides a mounting assembly for mounting a plurality of inkjet print modules that is cost-efficient and lightweight and that allows for precise adjustment of the positions of the inkjet print heads of the print modules.

The invention claimed is:

1. Mounting assembly for mounting a plurality of inkjet print modules in an adjoining relationship along a longitudinal direction of the mounting assembly, comprising a) a linear guide extending in the longitudinal direction for supporting the plurality of modules such that the modules are movable along the linear guide;

b) for each of the plurality of modules a carrier for mounting an inkjet print head including an array of nozzles formed on a nozzle face on a nozzle face side of the print module, wherein the carriers are supported on the linear guide such that they are movable along the linear guide;

c) wherein at least one of the carriers comprises a first adjustment mechanism for adjusting a distance of the carriers of two adjoining modules of the plurality of modules, the first adjustment mechanism comprising a first control member having an operating section for mechanically cooperating with a tool for adjusting the distance;

d) wherein at least one of the carriers further comprises a second adjustment mechanism for adjusting an angle position of the inkjet print head mounted to the carrier with respect to an axis perpendicular to the longitudinal direction, the second adjustment mechanism comprising a second control member having an operating section for mechanically cooperating with a tool for adjusting the angle position;

wherein the operating sections of the control members of the first and of the second adjustment mechanism are accessible from the nozzle face side of the print module.

2. Mounting assembly according to claim 1, wherein the control members are screws and the operating sections are screw heads.

3. Mounting assembly according to claim 2, at least one of the screws comprising a fine thread.

4. Mounting assembly according to claim 1, wherein the linear guide comprises two longitudinal rails and in that the carriers are slidably mounted on the rails.

5. Mounting assembly according to claim 4, wherein the rails comprise a mechanism for maintaining a predetermined temperature.

6. Mounting assembly according to claim 1, wherein the carriers are mounted to the linear guide in such a way that the plurality of carriers are urged against a first end of the linear guide, whereas the first adjustment mechanisms allow for adjusting the mutual distance of the carriers of two adjoining modules.

7. Mounting assembly according to claim 6, wherein a compression spring acts onto an outermost carrier opposite the first end of the linear guide for urging the plurality of carriers against the first end.

8. Mounting assembly according to claim 1, wherein the first adjustment mechanism comprises a first wedge element contacting two adjoining carriers, wherein a position of the first wedge element is adjustable by operating the first control member.

9. Mounting, assembly according to claim 8, wherein a lever cooperates with the first control member and the first wedge element.

10. Mounting assembly according to claim 1, wherein the second adjustment mechanism comprises a second wedge element mechanically coupled to the second control member for adjusting the angle position.

11. Mounting assembly according to claim 10, wherein the carrier comprises a rotatable mount for the inkjet print head, the rotatable mount having a projecting element cooperating with the second wedge element.

12. Inkjet printer comprising a) at least one mounting assembly according to claim 1;

b) an adjusting robot comprising a tool for cooperating with the operating sections of the control members of the first and of the second adjustment mechanism, the robot being arranged on the nozzle face side of the print modules supported by the linear guide.

13. The inkjet printer according to claim 12, wherein the adjusting robot selectively cooperates with a single one of the inkjet print heads, wherein the adjusting robot is movable along the longitudinal direction.

14. The inkjet printer according to claim 12, wherein the adjusting robot comprises a drive for rotatably operating the tool.

15. The inkjet printer according to claim 12, wherein the adjusting robot comprises an adjusting section comprising the tool and a cleaning section comprising a device for cleaning the array of nozzles of the inkjet print head mounted on a carrier in a cooperating position with the adjusting robot.

16. The inkjet printer according to claim 15, wherein the adjusting robot comprises a first operating configuration in which the adjusting section is in cooperating position with one of the plurality of carriers and a second operating configuration in which the cleaning section is in cooperating position with the array of nozzles of the inkjet print head mounted to the carrier.

17. The inkjet printer according to claim 15, wherein the device for cleaning comprises at least one lip for cooperating with the array of nozzles of the inkjet print head and least two nozzles for ejecting a cleaning agent and a rinsing solution, respectively.

18. Mounting assembly according to claim 1, wherein a mounted configuration of the inkjet print heads their nozzle face being arranged on a first side of the linear guide and wherein the operating sections of the control members of the first and of the second adjustment mechanism are accessible from the first side of the linear guide.

* * * * *